US010610004B1

(12) United States Patent
Yeo

(10) Patent No.: US 10,610,004 B1
(45) Date of Patent: Apr. 7, 2020

(54) MULTIPURPOSE HOLDER

(71) Applicant: Changki Yeo, Incheon (KR)

(72) Inventor: Changki Yeo, Incheon (KR)

( * ) Notice: Subject to any disclaimer, the term of this patent is extended or adjusted under 35 U.S.C. 154(b) by 0 days.

(21) Appl. No.: 16/268,411

(22) Filed: Feb. 5, 2019

(30) Foreign Application Priority Data

Dec. 19, 2018 (KR) ..... 10-2018-0165393
Jan. 4, 2019 (KR) ..... 10-2019-0001369

(51) Int. Cl.

| | |
|---|---|
| ***A45F 5/00*** | (2006.01) |
| ***A45C 11/00*** | (2006.01) |
| ***A45F 5/10*** | (2006.01) |
| ***A45C 11/18*** | (2006.01) |

(52) U.S. Cl.
CPC ..... *A45F 5/10* (2013.01); *A45C 11/182* (2013.01); *A45C 2011/002* (2013.01); *A45C 2011/003* (2013.01); *A45C 2200/15* (2013.01); *A45F 2005/1013* (2013.01); *A45F 2005/1086* (2013.01); *A45F 2200/0516* (2013.01); *A45F 2200/0525* (2013.01)

(58) Field of Classification Search
CPC ..... A45F 2200/0516; A45F 2200/055; A45F 2005/1086; A45F 2005/1013; A45F 5/10; A45C 2011/002; A45C 11/182; A45C 1/06; A45C 2200/15
See application file for complete search history.

(56) References Cited

U.S. PATENT DOCUMENTS

| | | | | |
|---|---|---|---|---|
| 1,598,719 | A * | 9/1926 | Hiering | A45C 13/26 150/108 |
| 4,763,763 | A * | 8/1988 | Sadow | A45C 13/26 150/108 |
| 5,111,952 | A * | 5/1992 | Stocchiero | H01M 2/1005 220/754 |
| 8,374,657 | B2 * | 2/2013 | Interdonato | H04B 1/385 455/575.4 |
| 8,550,317 | B2 * | 10/2013 | Hyseni | A45F 5/00 224/197 |
| D703,949 | S * | 5/2014 | Chappell | D3/249 |
| 8,726,952 | B2 * | 5/2014 | Jambunathan | A45C 11/00 150/134 |
| 8,757,376 | B2 * | 6/2014 | Azzoni | A45C 11/00 206/320 |
| 8,833,620 | B2 * | 9/2014 | Interdonato | H04B 1/385 224/217 |
| 9,362,968 | B1 * | 6/2016 | Haymond | H04B 1/385 |
| 9,369,167 | B2 * | 6/2016 | Choi | H04M 1/0202 |
| 10,001,243 | B2 * | 6/2018 | Cavalcante | H04B 1/385 |

(Continued)

*Primary Examiner* — Justin M Larson

(57) ABSTRACT

The present invention relates to a multipurpose holder. A central portion of a strap is bends or spreads out as one end portion moves closer to or away from an opposite end portion and a stopper is provided at the opposite end portion. When the strap is disposed at one face of a pad, one end portion of the strap is fixed at one edge of the pad, and when the strap is spread out, the opposite end portion is supported at opposite edge of the pad, and an area other than where the strap is disposed and operates is formed to be protruded. A strap guide has two end portions connected to one face of the pad while the strap guide partially covers the strap to guide the operation of the strap, and limits the proximity movement of the strap in a bent state by catching against the stopper.

5 Claims, 17 Drawing Sheets

(56) References Cited

U.S. PATENT DOCUMENTS

| | | | | |
|---|---|---|---|---|
| 10,063,272 | B1 * | 8/2018 | Yeo | H04B 1/3888 |
| 10,349,728 | B2 * | 7/2019 | Yoo | H04M 1/04 |
| 2007/0057004 | A1 * | 3/2007 | Butler | A45C 11/182<br>224/669 |
| 2011/0294556 | A1 * | 12/2011 | Carlberg | A45C 11/00<br>455/575.8 |
| 2011/0309117 | A1 * | 12/2011 | Roberts | A45F 5/00<br>224/217 |
| 2013/0119099 | A1 * | 5/2013 | Interdonato | H04B 1/385<br>224/217 |
| 2017/0328514 | A1 * | 11/2017 | Cavalcante | H04B 1/385 |
| 2018/0234126 | A1 * | 8/2018 | Yeo | H04B 1/3888 |
| 2019/0055062 | A1 * | 2/2019 | Winn | B65D 23/104 |

* cited by examiner

MULTIPURPOSE HOLDER

CROSS-REFERENCE TO RELATED APPLICATION

This application claims priority to and benefit of Korean Patent Application No. 10-2018-0165393 filed on Dec. 19, 2018 and Korean Patent Application No. 10-2019-0001369 filed on Jan. 4, 2019, the disclosure of which is hereby incorporated by reference in its entirety.

BACKGROUND OF THE INVENTION

Field of the Invention

The present invention relates to a holder that can be used variously on a portable terminal and the like.

Description of the Related Art

A cellular phone, which is a type of portable terminal, is widely used as a personal communication means capable of voice communication and wireless communication even on the move. Recently, in addition to voice calls, intelligent terminals such as smart phones and tablet computers, which have added computer support functions such as Internet communication and multimedia functions, are mainly being used.

Meanwhile, in general, a user holds and uses the portable terminal with his/her hands. However, since a portable terminal such as a smart phone is rather wide due to a large screen, it may be inconvenient for a user with a small hand to hold and operate the portable terminal with one hand. While the portable terminal is held and used, if the portable terminal slips out from the hand or is dropped due to bumping into another person, the portable terminal may cause damage or breakage.

SUMMARY OF THE INVENTION

The present invention is directed to providing a multipurpose holder that can enhance convenience by enabling a user to use the same in various ways.

According to an aspect of the present invention, there is provided a multipurpose holder including a strap, a pad, and a strap guide. The strap operates such that a central portion is bent or spread out as one end portion moves closer to or away from an opposite end portion and is provided with a stopper at the opposite end portion. In a state where the strap is disposed at one face of the pad, one end portion of the strap is fixed at one edge of the pad. In a state where the strap is spread out, the opposite end portion is supported at an opposite edge of the pad. The area other than the area where the strap is disposed and operates is formed to be protruded. The strap guide is connected to one face of the pad at both end portions in a state where the strap guide covers a part of the strap to guide the operation of the strap. The strap guide limits the proximity movement of the strap in a bent state by catching against the stopper.

In a further aspect, the multipurpose holder may include a card pocket formed on an opposite face of the pad so as to receive a card through an entrance adjacent to one edge of the pad, a guide hole formed to be in communication with the card pocket by being cut into the pad along a trajectory in which the opposite end portion of the strap moves, and a pushing protrusion formed at the opposite end portion of the strap which catches against an edge of the card within the card pocket in a state of being fitted in the guide hole such that the card is withdrawn from the card pocket when moved to the strap guide.

According to the present invention, the multipurpose holder can be used in various ways, such as allowing a portable terminal to be used while holding the portable terminal in a stable manner and allowing a card to be housed if necessary, thereby increasing ease of use.

DETAILED DESCRIPTION OF THE EMBODIMENTS

Figure 1:
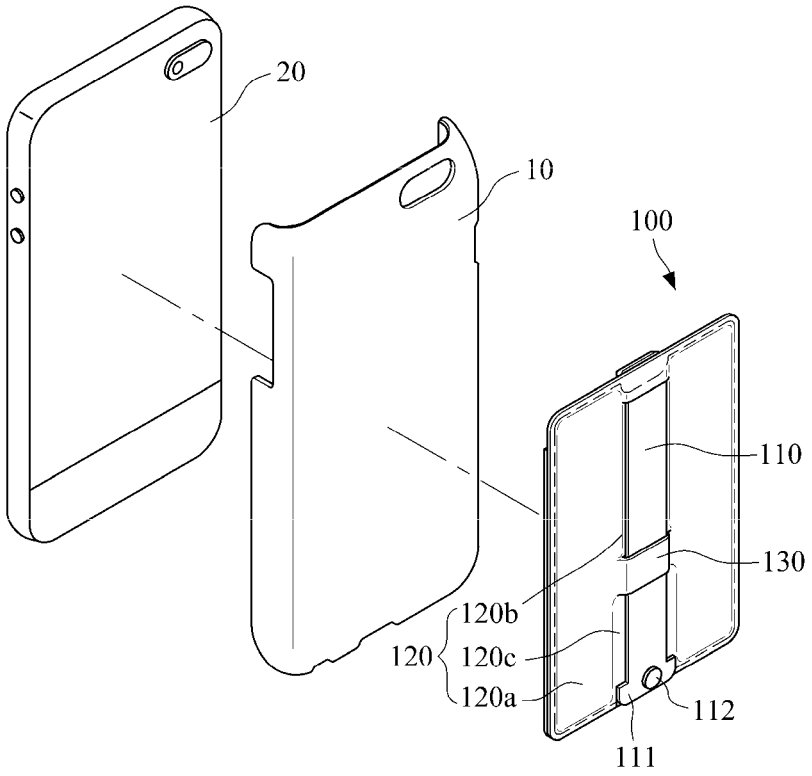
FIG. 1 is a perspective view of a multipurpose holder according to an embodiment of the present invention.

The present invention will be described in detail with reference to the accompanying drawings. Here, the same reference numerals are used for the same components, and a detailed description of known functions and configurations that may unnecessarily obscure the gist of the present invention will be omitted. Embodiments of the present invention are provided to more fully describe the present invention to those skilled in the art. Accordingly, the shape and size of the elements in the drawings and the like can be exaggerated for clarity.

Figure 2:
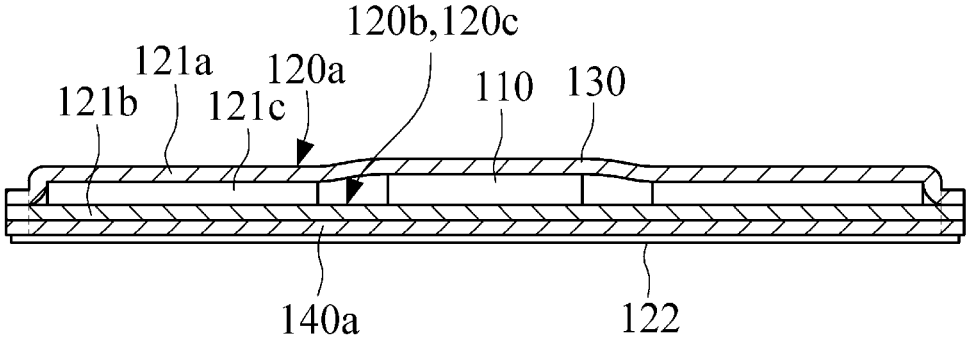
FIG. 2 is a cross-sectional view of the multipurpose holder shown in FIG. 1 cut in a transverse direction.
Figure 3:
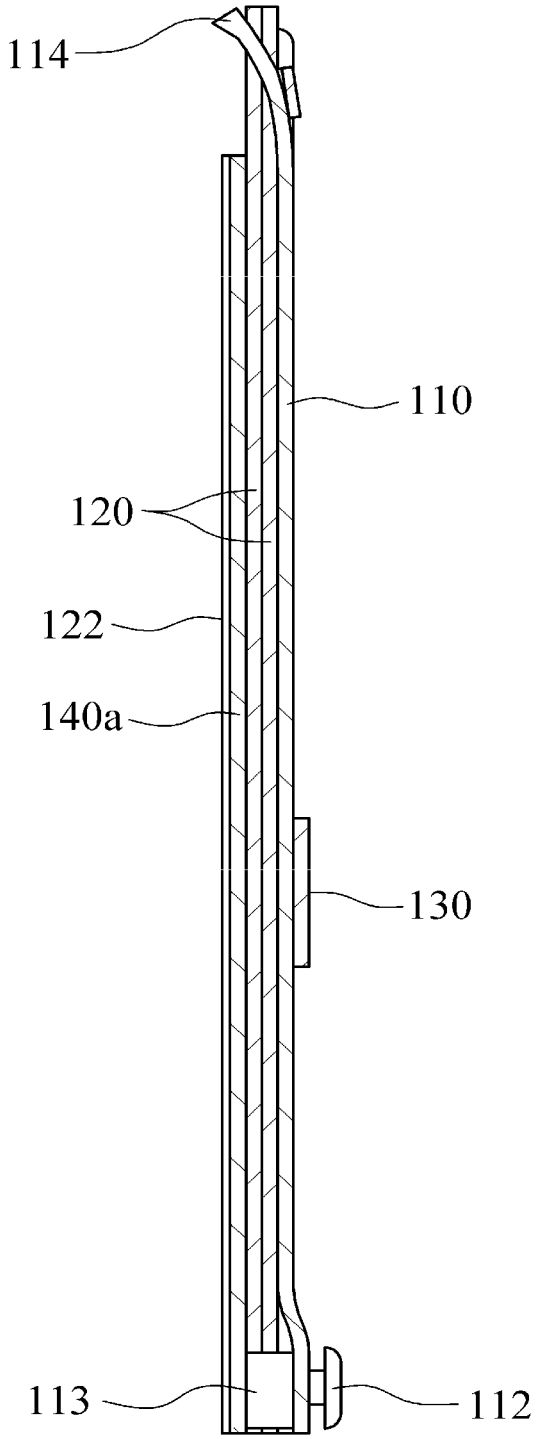
FIG. 3 is a cross-sectional view of the multipurpose holder shown in FIG. 1 cut in a longitudinal direction.
Figure 4:
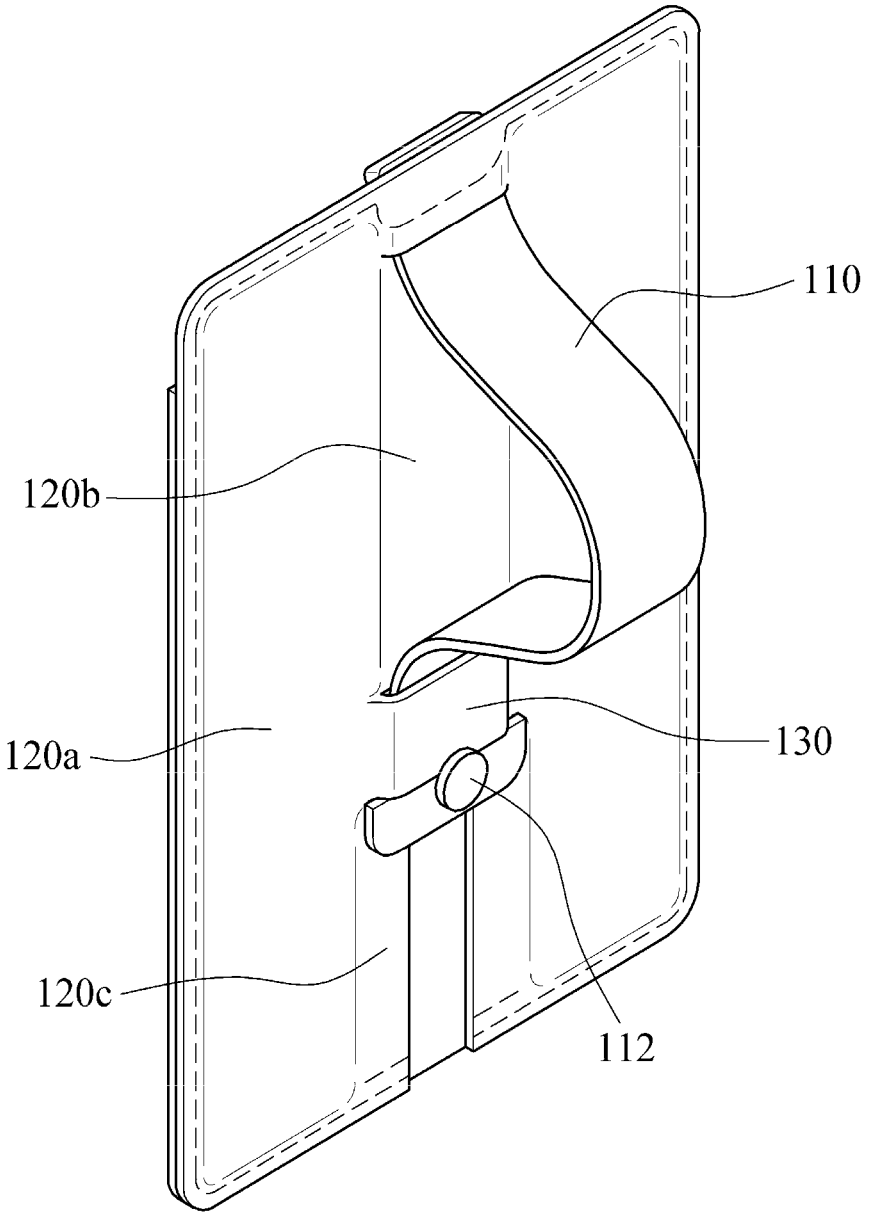
FIG. 4 is a perspective view of FIG. 1 showing a state where a central portion of a strap is bent.
Figure 5:
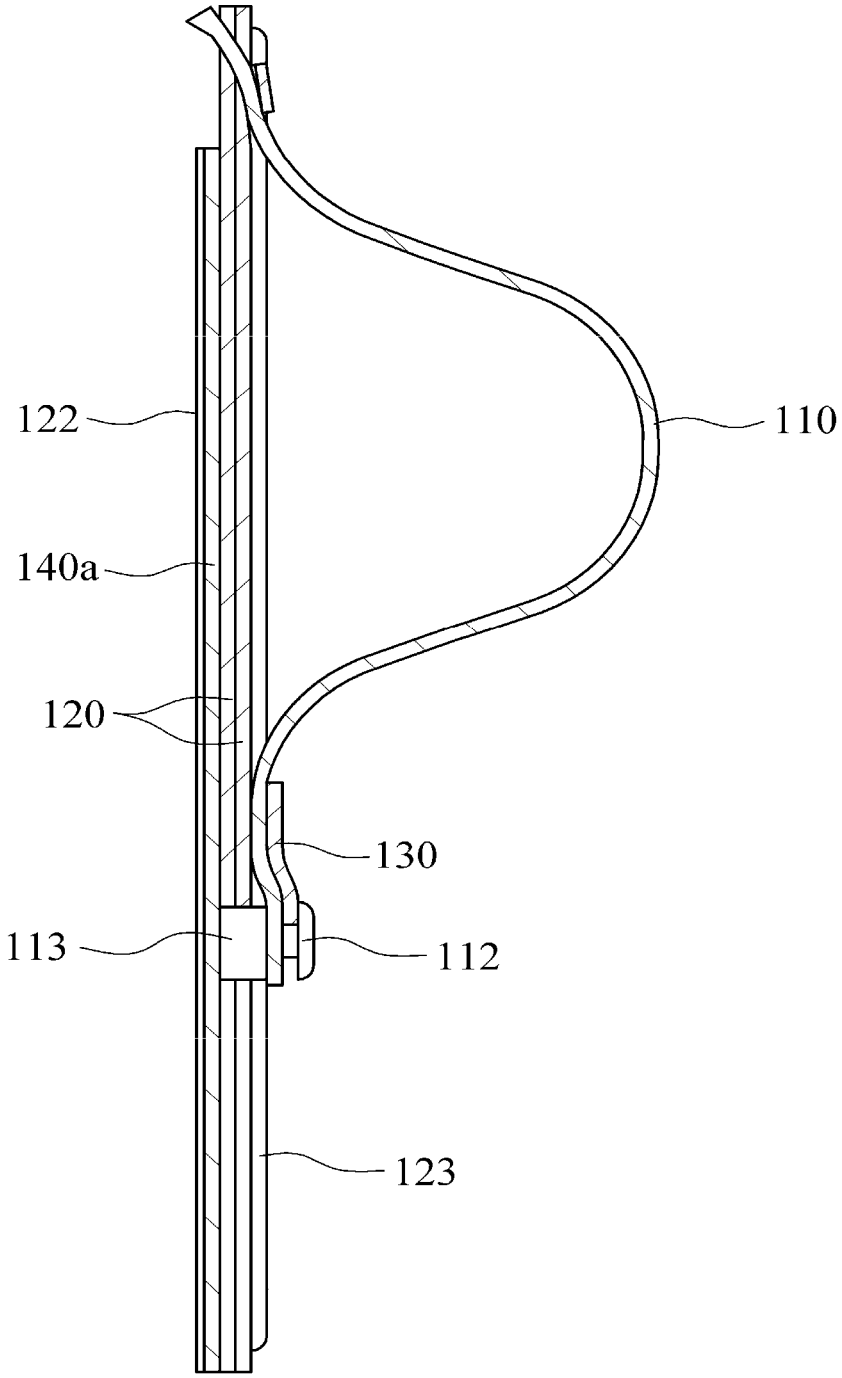
FIG. 5 is a cross-sectional view of FIG. 4.

FIG. 1 is a perspective view of a multipurpose holder according to an embodiment of the present invention. FIG. 2 is a cross-sectional view of the multipurpose holder shown in FIG. 1 cut in a transverse direction. FIG. 3 is a cross-sectional view of the multipurpose holder shown in FIG. 1 cut in a longitudinal direction. FIG. 4 is a perspective view of FIG. 1 showing a state where a central portion of a strap is bent. FIG. 5 is a cross-sectional view of FIG. 4.

Referring to FIGS. 1 to 5, a multipurpose holder 100 according to an embodiment of the present invention includes a strap 110, a pad 120 and a strap guide 130.

The strap 110 operates such that a central portion is bent or spread out as one end portion moves closer to or away from an opposite end portion. That is, the strap 110 operates such that the central portion is bent or spread out as a free end portion moves closer to or away from a fixed end portion fixed to the pad 120. The strap 110 is made of a bendable material. The strap 110 may be made of a material such as rubber, urethane, silicon or the like, or alternatively may be made of a leather material.

The strap 110 is provided with a stopper 111 formed at the opposite end portion, that is, at a free end portion. The stopper 111 can get caught against the strap guide 130 and be stopped in a state where the strap 110 is bent, thereby limiting the proximity movement of the strap 110.

The stopper 111 can be formed integrally with the strap 110. The stopper 111 may be extended to both sides of the free end portion of the strap 110 in the same shape. The end of the stopper 111 may be formed to coincide with the end of the adjacent strap 110. The stopper 111 may have rounded corners near the edge of the pad 120. A portion of the strap 110 excluding the stopper 111 may have a constant width.

In a state where the strap 110 is disposed at one face of the pad 120, one end portion of the strap 110 is fixed at one edge. The pad 120 supports the opposite end portion of the strap 110 at the opposite edge of the strap 110 in a spread out state.

The pad 120 may be formed to have a length that is the same as the length of the strap 110 in the spread out state and a width that is wider than that of the strap 110, to support the strap 110. The pad 120 may have a rectangular shape. Each corner of the pad 120 may have rounded forms.

The pad 120 can fix one end portion of the strap 110 to one edge with the strap 110 positioned along the middle of one face of the pad. Of course, the pad 120 may have various shapes other than a rectangular shape. The pad 120 may be made of a leather material, but may also be made of rubber, urethane, silicon, or plastic.

The pad 120 has a shape in which area 120*a* is protruded, the area 120*a* being an area excluding areas 120*b* and 120*c* where the strap 110 is disposed and operated. Accordingly, the pad 120 is formed such that the area 120*b* in which the strap 110 is disposed and operated is relatively recessed. The recessed areas 120*b* and 120*c* of the pad 120 allow the strap 110 to be received in a spread out state.

As a comparative example, if one face of the pad is made to be entirely flat and the pad is laid down with the strap on the flat face of the pad facing the floor, the strap comes into contact with the floor while protruding from the pad, and so the pad may be unstably supported due to the swaying that can occur around the strap.

However, according to the present embodiment, in a state where the strap 110 is spread out and laid down facing the floor, it is received in the recessed areas 120*b* and 120*c* of the pad 120, so the strap 110 does not protrude from the pad 120. Thus, the pad 120 can be stably supported due to the protruding area 120*a* around the strap 110 being in contact with the floor as a whole.

As a result, when a pad 120 is attached with a protective case 10 or a portable terminal 20 at an opposite side of the side where the strap 110 is disposed, the protective case 10 or the portable terminal 20 can be stably mounted without any swaying when laid down on the floor through the pad 120.

The protruding area 120*a* of the pad 120 may protrude as much as the thickness of the strap 110 but may also be more protruded than the thickness of the strap 110. The pad 120 has a recessed area 120*b* extending from the fixed end portion of the strap 110 to the strap guide 130 that may have a width equal to or wider than the width of the strap 110. The recessed area 120*c* where the stopper 111 of the strap 110 moves may have a width equal to or wider than the width of the stopper 111.

The pad 120 may include an inner member 121*c* to form the protruding area 120*a*. The pad 120 may be configured to have the inner member 121*c* disposed between two pad sheet members 121*a* and 121*b* for the pad which can be joined along the edge by a sewing method or the like. Of course, the pad sheet members 121*a* and 121*b* may be adhered to each other with an adhesive. The inner member 121*c* has a size and a thickness capable of forming the protruding area 120*a* of the pad 120 together with the two pad sheet members 121*a* and 121*b*.

An adhesive member 122 such as a double-sided tape may be adhered to the pad 120 on the opposite side of the side where the straps 110 are disposed. When the card pocket 140 is formed on the opposite side of the pad 120, the adhesive member 122 can be adhered to the outside of the card pocket 140. By having an exposed adhesive surface of the adhesive member 122 adhered to the rear surface of the protective case 10 for the portable terminal, the pad 120 can be attached to the rear surface of the protective case 10 for the portable terminal. It is also possible for the pad 120 to be attached to the rear surface of the portable terminal 20.

As another example, the pad 120 may have a gel-type adhesive sheet instead of the adhesive member 122. In this case, the pad 120 can easily be attached to or removed from the protective case 10 or the portable terminal 20.

The strap guide 130 is connected to one face of the pad 120 at both end portions in a state where the strap guide 130 covers a part of the strap 110 to guide the operation of the strap 110. The strap guide 130 limits the proximity movement of the strap 110 in a bent state by catching against the stopper 111.

The strap guide 130 forms a fitting hole in between the pad 120 and the strap guide 130 and a part of the strap 110 is inserted into the fitting hole to guide the movement of the strap 110. The fitting hole has a narrower width than the stopper 111 so as to catch the stopper 111 of the strap 110. The fitting hole may be spaced apart from the strap 110 to have a width wider than the width of the strap 110 to facilitate the operation of the strap 110. The strap guide 130 may have a rectangular band shape.

The strap guide 130 may be formed integrally with the pad 120. The strap guide 130 may be formed by cutting a part of the pad 120 into a ring shape. In the case where the pad 120 is joined with two pad sheet members 121*a* and 121*b*, the pad sheet member 121*a* adjacent to the strap 110 may be partially cut in two lines to form the strap guide 130. The maximum size of the annular shape formed by the strap 110 can be set depending on the position of the strap guide 130.

The opposite end portion of the strap 110, that is, the free end portion may include a fitting piece 112 which is moved to the strap guide 130 and is fixed with the strap guide 130 at a fitted state. One end portion of the fitting piece 112 may be fixed to the outer surface of the strap 110 and the opposite end portion of the fitting piece 112 may be formed in an extended shape with a gap between the outer surface of the strap 110. The opposite end portion of the fitting piece 112 can fit and fix the strap guide 130 within the gap formed between the opposite end portion and outer surface of the strap 110. The fitting piece 112 may be made of a metal material and can be fixed to the free end portion of the strap 110 by a rivet or the like. The fitting piece 112 may also be made of a plastic material.

An example of using the above-described multipurpose holder 100 will be described below. Here, the case where the multipurpose holder 100 is attached to a rear surface of a protective case 10 for a portable terminal is taken as an example, but it can be used in the same way when attached to a portable terminal 20.

First, a multipurpose holder 100 is attached to a rear surface of a protective case 10 for a portable terminal through a pad 120 by a user, and the strap 110 is in a state spread out side by side with the pad 120.

In this state, the user pushes and moves a free end portion of the strap 110 closer towards a fixed end portion of the strap 110. In this process, a central portion of the strap 110, which moves through the strap guide 130 towards the fixed end portion of the strap 110, is convexly curved from one face of the pad 120 to form an annular space.

Figure 6:
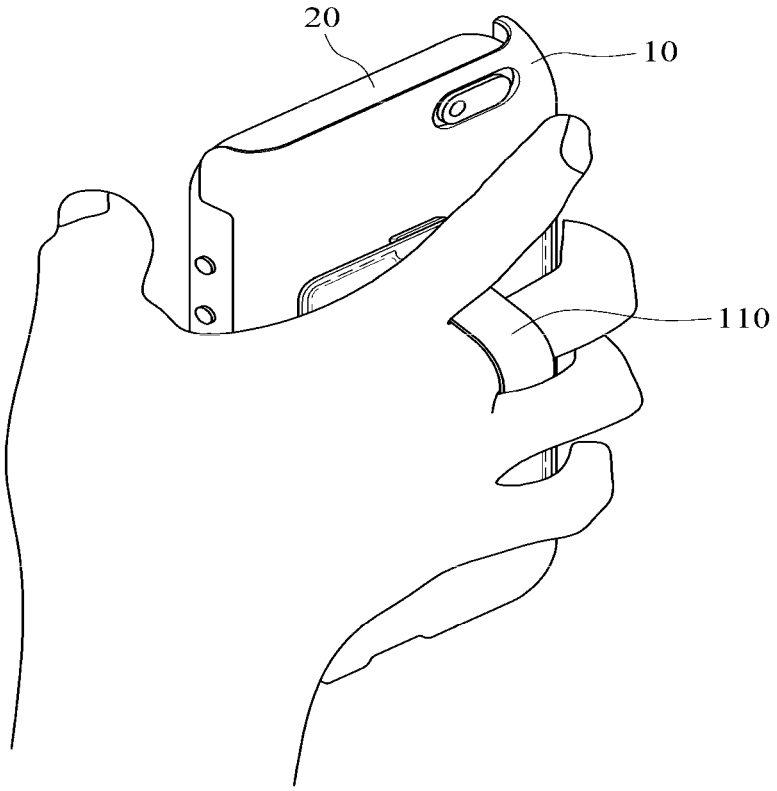
FIG. 6 is a perspective view showing an example of use of the multipurpose holder.

Then, as shown in FIG. 6, the user can grip the protective case 10 for the portable terminal by putting his or her finger in the annular space of the strap 110. Thus, it is possible to use the portable terminal 20 that is mounted on the protective case 10 while being stably held by one hand.

Thereafter, when it is no longer necessary to use the strap 110 in the above-described form, the user can pull the free end portion of the strap 110 apart from the fixed end portion of the strap 110 or push the convex portion of the strap 110 so as have the strap 110 spread out side by side with the pad 120.

Figure 7:
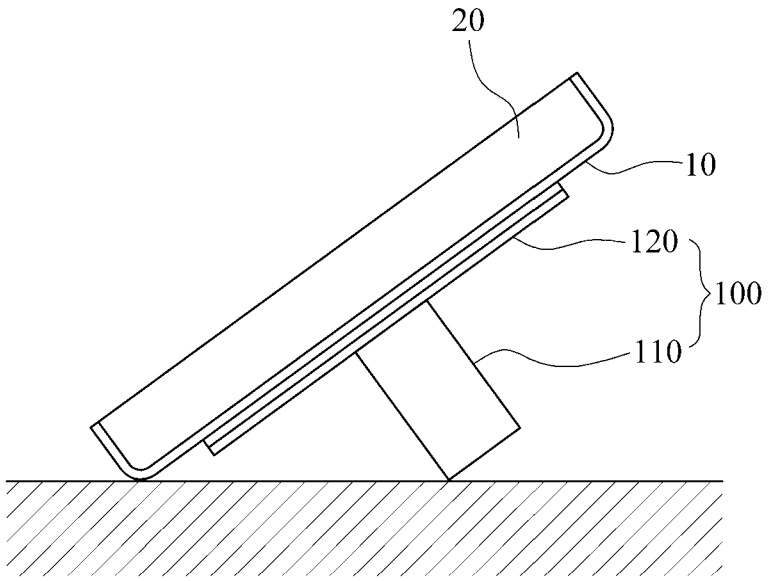
FIG. 7 is a side view showing another example of use of the multipurpose holder.

As another example, as shown in FIG. 7, the user can make the central portion of the strap 110 into a ring shape through the above-described process and when the multipurpose holder 100 is placed on the floor, it is possible to function as a stand for holding the portable terminal 20 in a tilted state.

Figure 8:
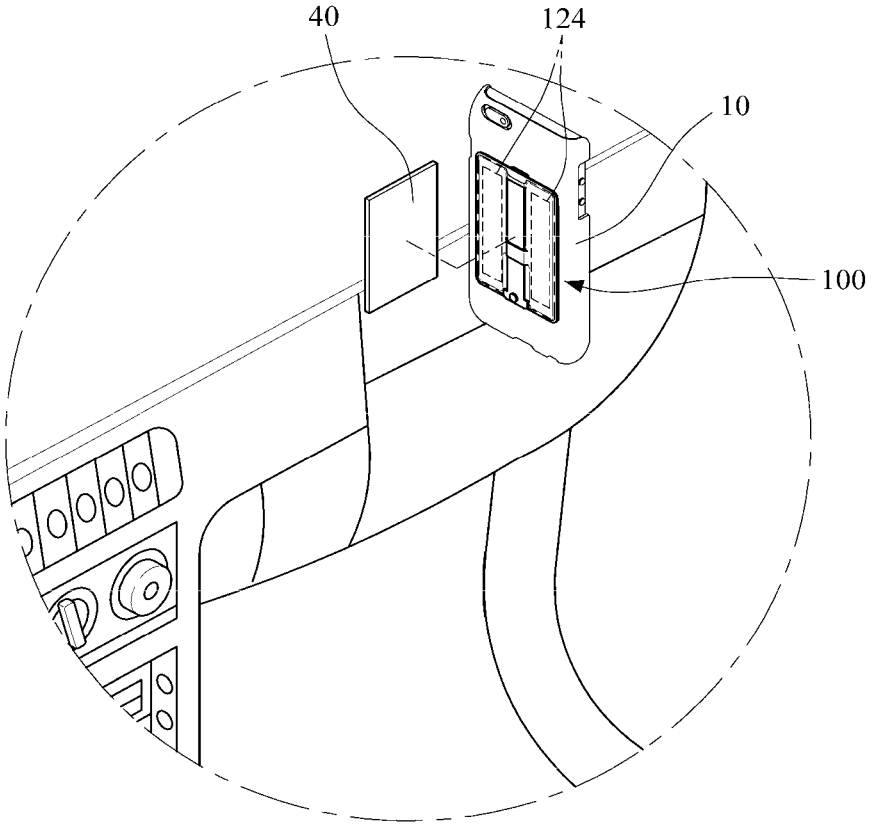
FIG. 8 is a perspective view showing yet another example of use of the multipurpose holder.
Figure 9:
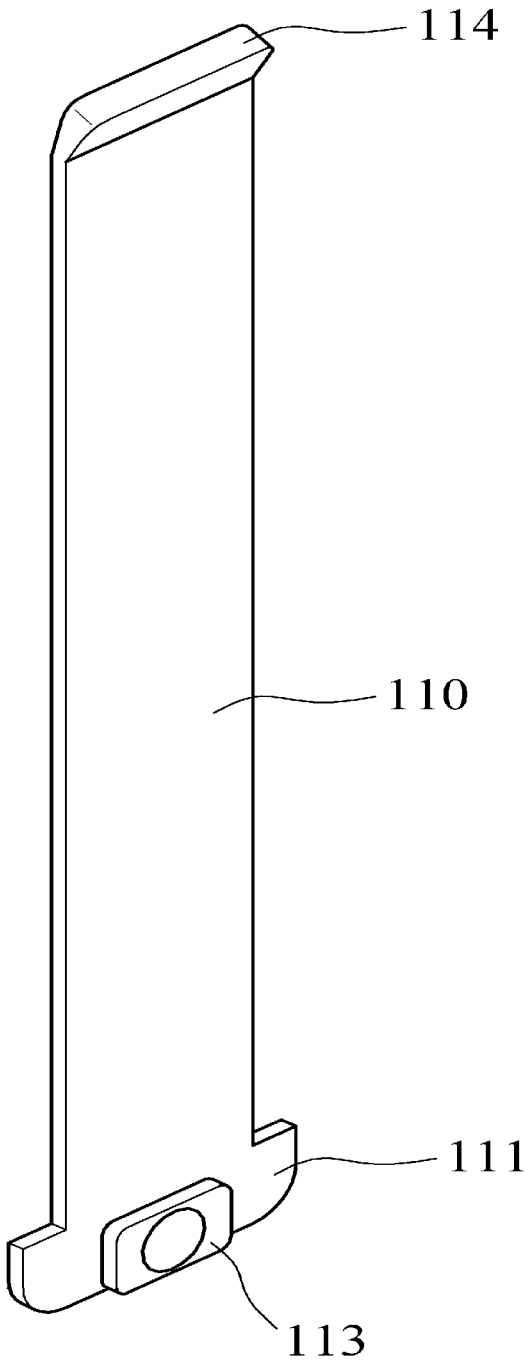
FIG. 9 is a perspective view showing a pushing protrusion of the strap.
Figure 10:
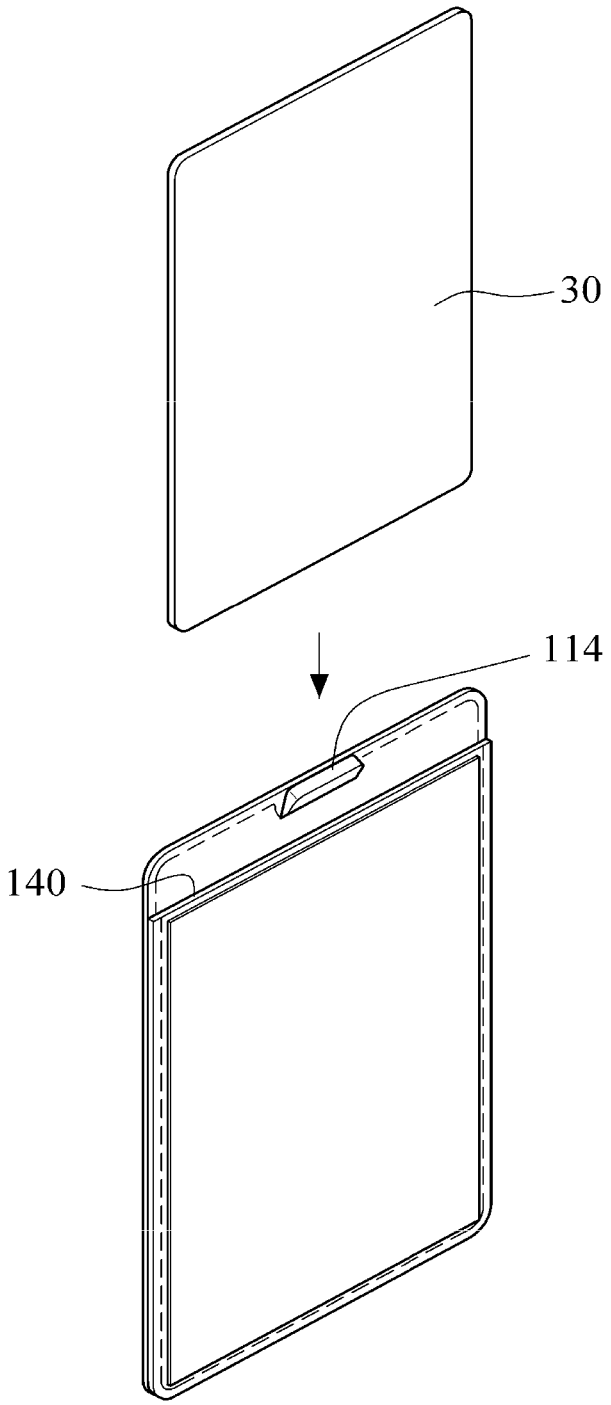
FIGS. 10 and 11 are perspective views for explaining a process of housing a card in a card pocket.
Figure 11:
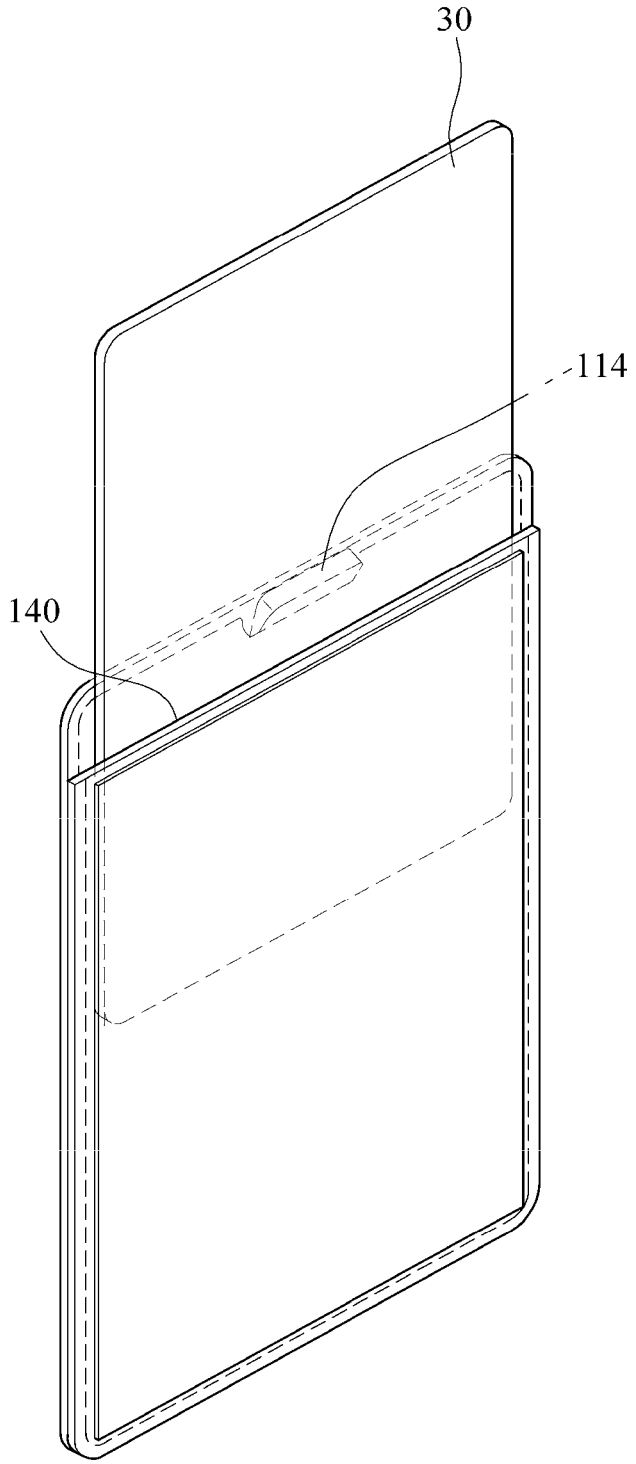
Figure 12:
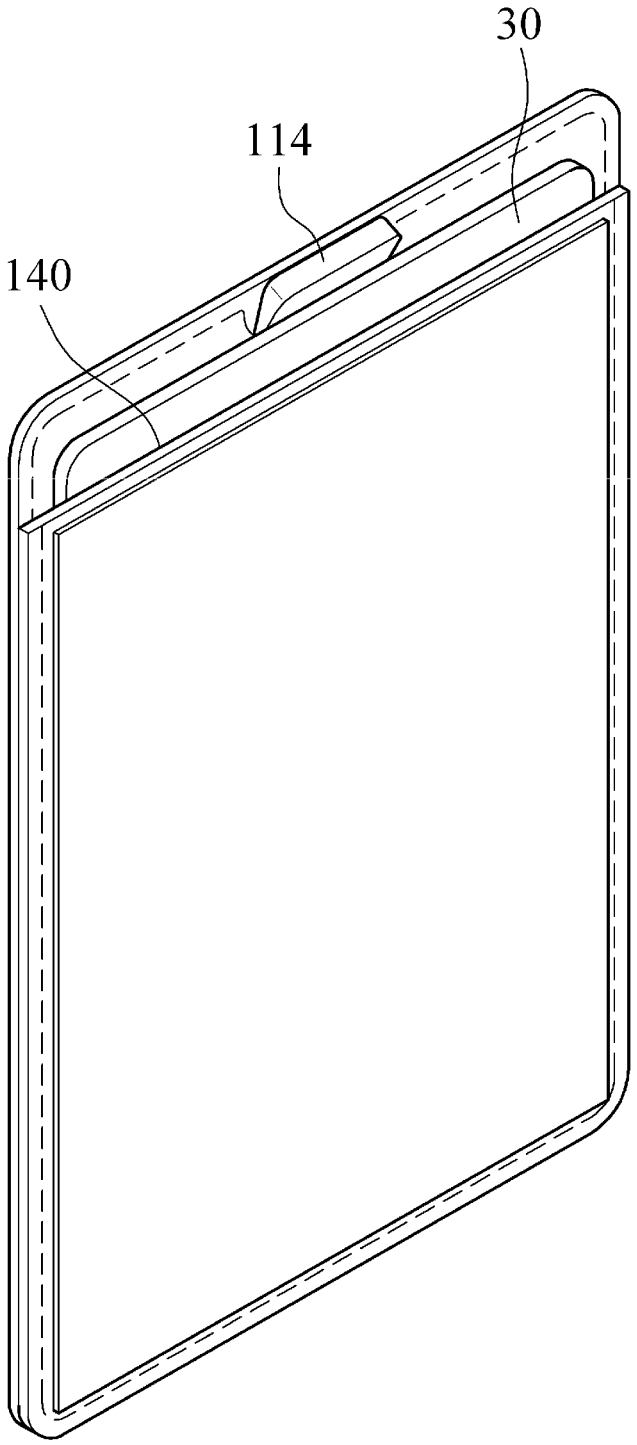
FIG. 12 is a perspective view showing a state in which a card is housed in a card pocket.

As another example, the pad 120 may have a permanent magnet 124 embedded therein, as shown in FIG. 8. The permanent magnet 124 may be disposed in the protruding area 120*a* of the pad 120. In this case, a magnetic metal pad 40, which can be magnetically attached with the permanent magnet 124, can be attached to the interior of a vehicle.

Alternatively, although not shown, the pad 120 may incorporate a magnetic metal pad instead of embedding the permanent magnet 124 therein. In this case, a permanent magnet capable of magnetically attaching the magnetic metal pad of the pad 120 may be mounted inside the vehicle. Therefore, the user can attach and hold the multipurpose holder 100 inside the vehicle.

On the other hand, when the pad 120 includes the permanent magnet 124, the adhesive member 122 may be omitted. By having a magnetic metal pad that can be magnetically attached to the permanent magnet 124 attached to the rear surface of the protective case 10 for the portable terminal or to the rear surface of the portable terminal 20, the multipurpose holder 100 can be easily attached and detached.

Meanwhile, referring to FIGS. 9 to 14 along with FIGS. 1 to 5, the multipurpose holder 100 may include a card pocket 140, a guide hole 123, and a pushing protrusion 113. The card pocket 140 is formed on an opposite face of the pad 120 for receiving a card 30 through an entrance adjacent to one edge of the pad 120. That is, the card pocket 140 is formed on the face that is on the opposite side of the pad 120 on which the strap 110 is disposed.

The card pocket 140 may be formed by coupling the pocket sheet member 140*a* to the opposite side of the pad 120. The pocket sheet member 140*a* may be disposed on the opposite face of the pad 120 and joined to the pad 120 at edges excluding the edge towards the fixed end portion of the strap 110, to form the card pocket 140.

The entrance of the card pocket 140 may be located more inward than one edge of the pad 120. The pocket sheet member 140*a* may have a shorter length than the pad 120 and may have the same width as the pad 120. The pocket sheet member 140*a* may be coupled in a state where one edge forming the entrance is disposed to be located more inward than one edge of the pad 120, with the other edges of the pocket sheet member 140*a* being aligned with the other edges of the pad 120.

One end portion of the strap 110 may be fixed to the pad 120 while being withdrawn around the entrance of the card pocket 140 through one edge of the pad 120. One end portion of the strap 110 may be connected to a peripheral portion passing through one edge of the pad 120 by a sewing method or the like. One edge of the pad 120 may be formed as a cut portion corresponding to a portion where one end portion of the strap 110 is withdrawn.

One end portion of the strap 110 may be formed with a protrusion 114 on a surface of the card pocket 140 facing the periphery of the entrance. The protrusion 114 guides the card 30 to be smoothly housed when the card 30 is housed through the entrance of the card pocket 140. In addition, the protrusion 114 can prevent the card 30 from being lost by catching against the card 30 housed in the card pocket 140 when it slips out to a certain extent. The protrusion 114 may have a form of gradually thickening towards the outside.

The guide hole 123 is formed to be in communication with the card pocket 140 by being cut into the pad 120 along a trajectory in which the opposite end portion of the strap 110 moves. The guide hole 123 can guide the linear movement of the pushing protrusion 113 with a constant width.

The pushing protrusion 113 is formed at the opposite end portion of the strap 110 and catches against an edge of the card 30 within the card pocket 140 such that the card 30 is withdrawn from the card pocket 140 when moved to the strap guide 130 in a state of being fitted in the guide hole 123

Figure 13:
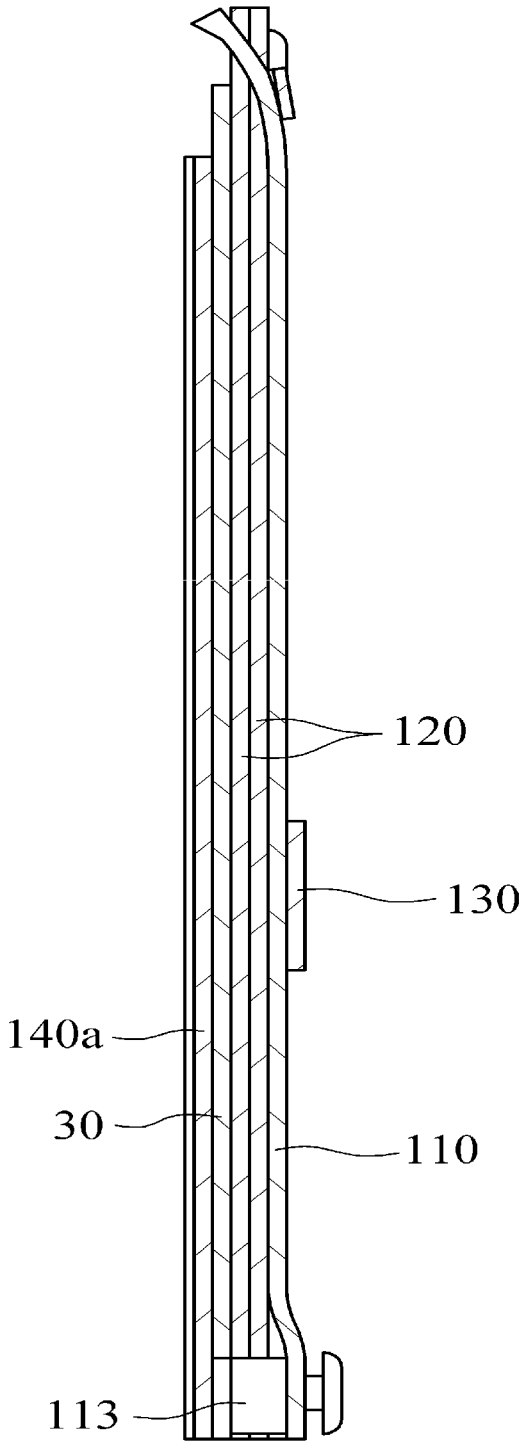
FIG. 13 is a cross-sectional view of FIG. 12.

That is, referring to FIG. 13, the pushing protrusion 113 may be partly fitted into the guide hole 123 and can stay out from the edge of the card 30 in the card pocket 140. The user can move the free end portion of the strap 110 toward the fixed end portion of the strap 110 while keeping the pushing protrusion 113 away from the edge of the card 30 in the card pocket 140, thereby making it possible to make the strap 110 into an annular shape without withdrawing the card 30.

Figure 14:
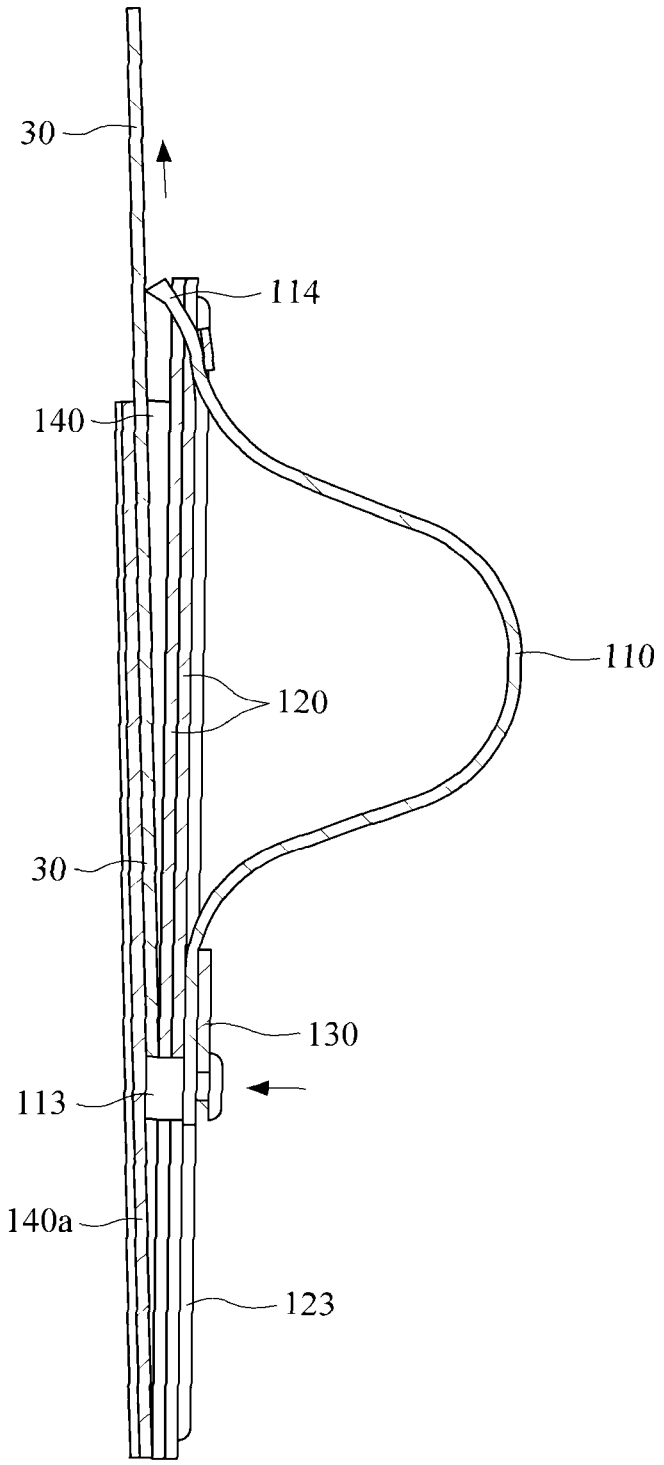
FIG. 14 is a cross-sectional view for explaining the process of withdrawing a card from a card pocket.

When the user wants to draw the card 30 out of the card pocket 140, as shown in FIG. 14, the pushing protrusion 113 is pushed inwardly to be caught against the edge of the card 30 in the card pocket 140. As the user moves the free end portion of the strap 110 toward the fixed end portion of the strap 110 along the guide hole 123 while the pushing protrusion 113 is caught against the edge of the card 30 in the card pocket 140, the card 30 in the card pocket 140 can be easily drawn out.

The pushing protrusion 113 is formed in the shape of a rectangular block and is fixed to the inner surface of the strap 110. Both surfaces of the pushing protrusion 113 fit into both sides of the inner surfaces of the guide hole 123 such that the pushing protrusion 113 is able to move stably. The pushing protrusion 113 may have inclined surfaces in which both sides thereof are widened toward the guide hole 123 side. That is, the pushing protrusion 113 may have a trapezoidal cross-sectional shape and be held in the guide hole 123 in a fitted state. The pushing protrusion 113 can be fixed to the strap 110 together with the fitting piece 112. The pushing protrusion 113 may be made of a plastic material or a metal material.

The card pocket 140 is formed in a closed form so that the innermost edge of the card 30 can be positioned more inside than the pushing protrusion 113 in a state in which the card 30 is completely housed. Therefore, the card 30 can be drawn out with its innermost edge easily caught by the pushing protrusion 113. The card pocket 140 is sewn such that the innermost edge is sewn to be closed in the periphery of the guide hole 123 thereby it is possible to limit the innermost edge of the card 30 to be positioned more inside than the pushing protrusion 113.

As described above, in the multipurpose holder 100 according to the embodiment of the present invention, the portable terminal 20 can be used while being held in a stable state and a card 30 can be housed as necessary. In such ways, it is possible to use in various ways, so the usability can be improved.

Figure 15:
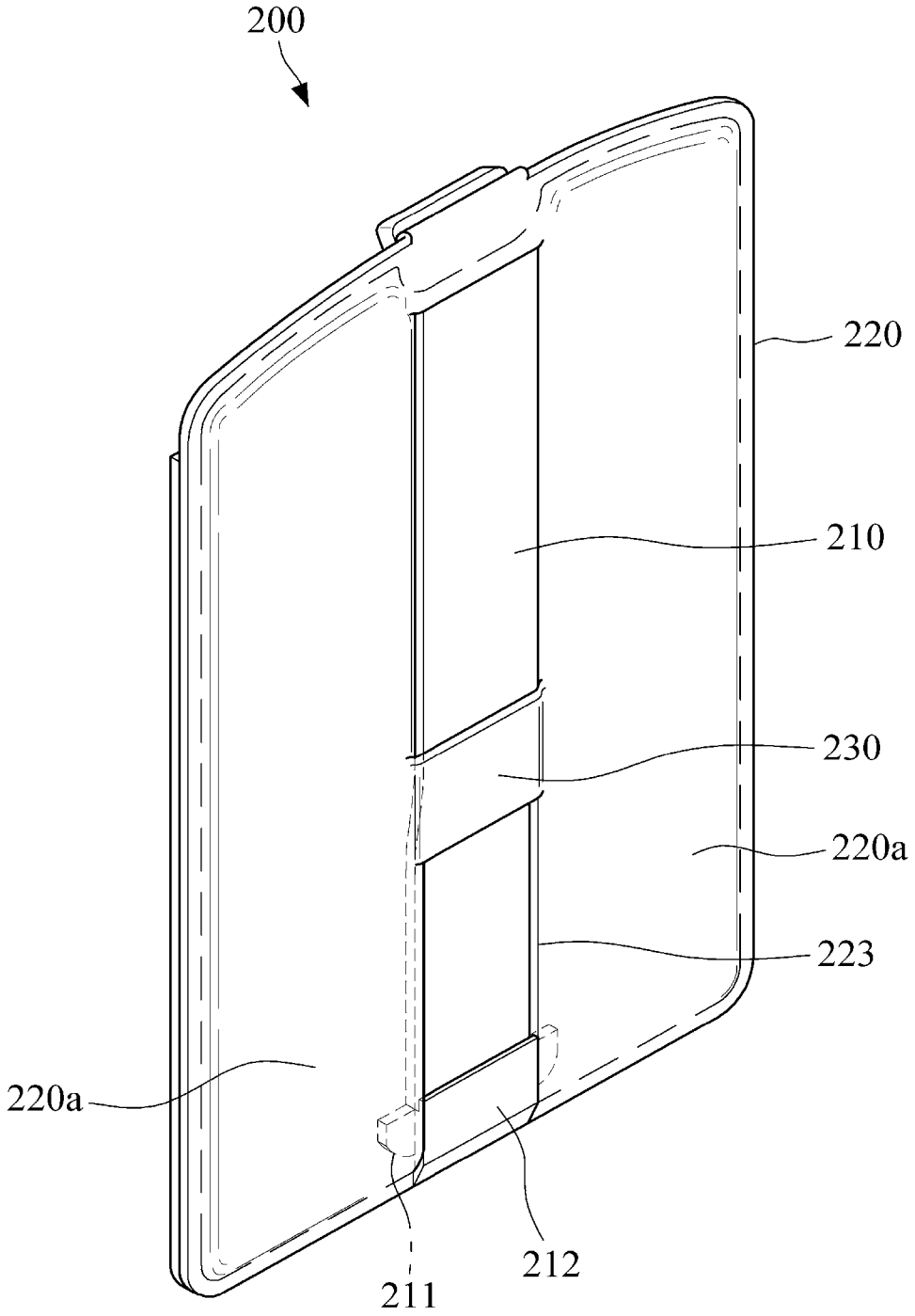
FIG. 15 is a perspective view of a multipurpose holder according to another embodiment of the present invention.
Figure 16:
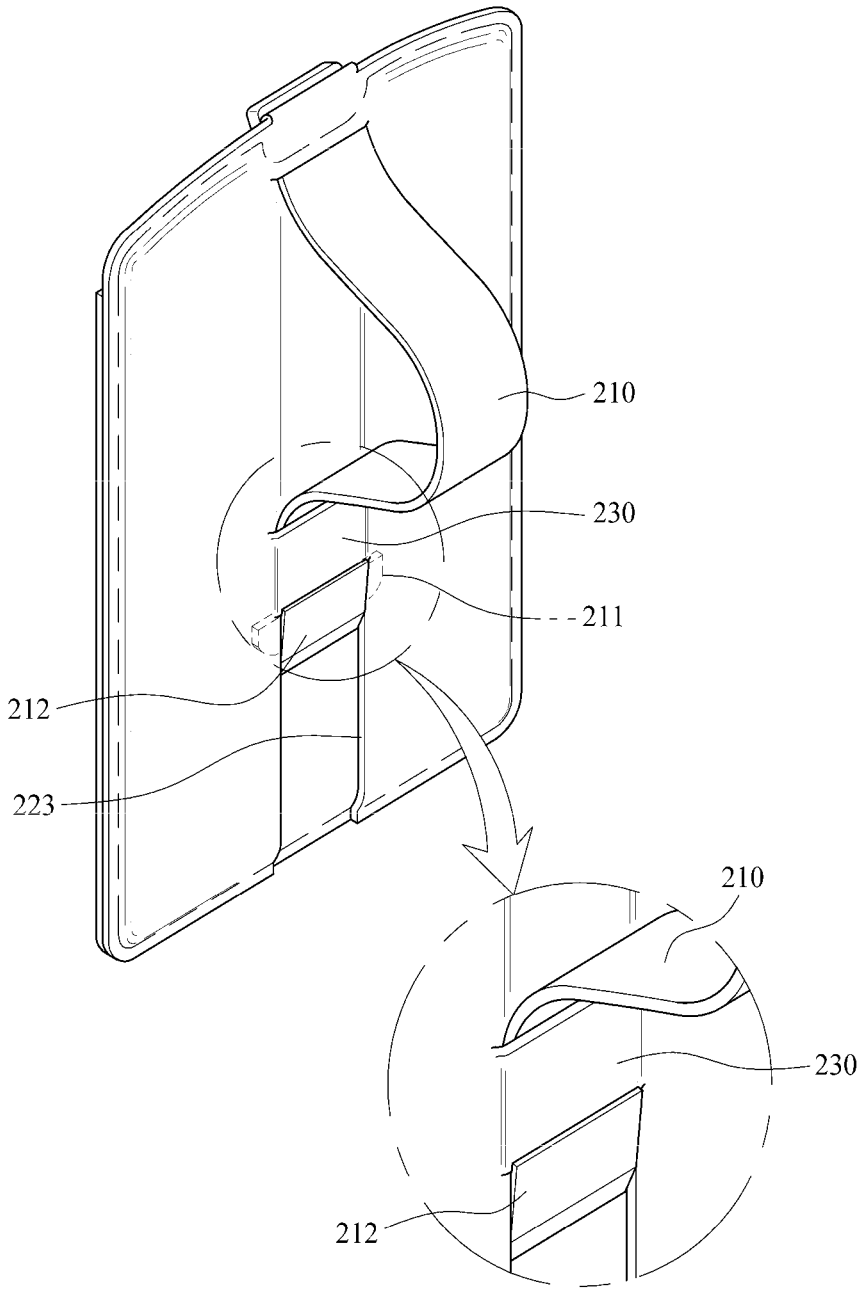
FIG. 16 is a perspective view of FIG. 15 showing a state where a central portion of a strap is bent.
Figure 17:
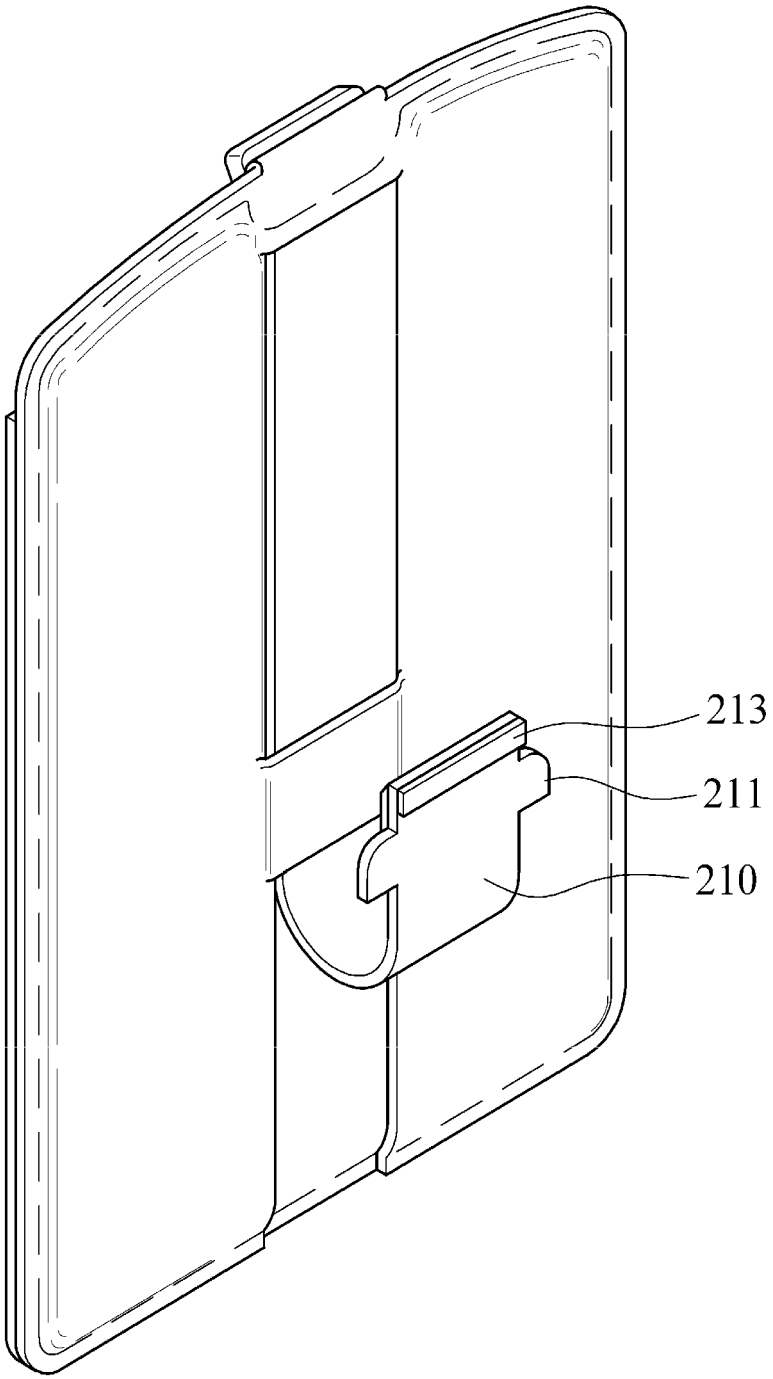
FIG. 17 is a perspective view of FIG. 15 showing a free end part of the strap.
Figure 18:
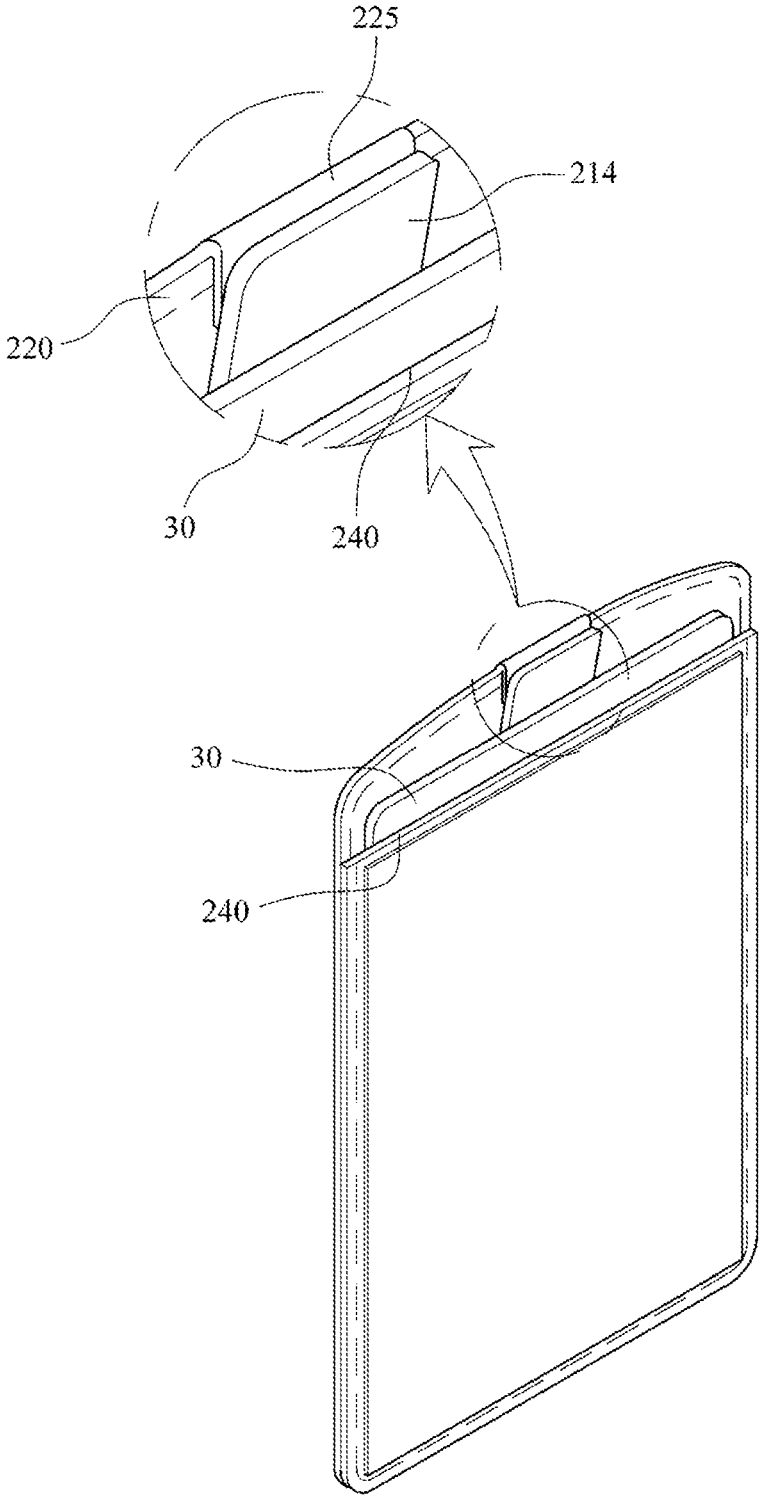
FIG. 18 is a perspective view of FIG. 15 showing an entrance part of a card pocket.

FIG. 15 is a perspective view of a multipurpose holder according to another embodiment of the present invention. FIG. 16 is a perspective view of FIG. 15 showing a state where a central portion of a strap is bent. FIG. 17 is a perspective view of FIG. 15 showing a free end part of the strap. FIG. 18 is a perspective view of FIG. 15 showing an entrance part of a card pocket.

Referring to FIGS. 15 to 18, in the multipurpose holder 200 according to another embodiment of the present invention, a portion excluding the stopper 211 in the strap 210 may have a predetermined width similar to the strap 110 of the embodiment described above. The stopper 211 may have same shape as that of the stopper 111 in the embodiment described above. However, the end of the stopper 211 may be formed to be closer to the strap guide 230 than the end of the adjacent strap 210, away from the end of the adjacent strap 210.

The strap guide 230 may be configured in the same manner as the strap guide 130 of the above-described embodiment. The card pocket 240 is formed on the opposite face of the pad 220 to house the card 30 through an entrance adjacent to one edge of the pad 220, like that of the card pocket 140 of the above-described embodiment.

The guide hole 233 is formed by being cut into the pad 220 from the strap guide 230 to the opposite edge of the pad 220 with a predetermined width so as to be in communication with the card pocket 240. The guide hole 223 is formed to fit an opposite end portion of the strap 210 in a state where the stopper 211 is introduced into the card pocket 240 and covered by the pad 220, to move and guide the strap 210 to the strap guide 230.

Therefore, the opposite end portion of the strap 210, that is, the free end portion of the strap 210, can be guided by the guide hole 223 and move linearly close to or spaced from the strap guide 230. The free end portion of the strap 210 is moved linearly close to or spaced apart from the strap guide 230 in a state where deviation from the guide hole 223 is prevented due to the stopper 211 introduced to the card pocket 240.

The guide hole 223 is formed only up to the portion of the strap guide 230 close to the opposite edge of the pad 220 so that in a state where the stopper 211 is moved to the strap guide 230, it can be caught against a portion of the pad 220 inside the strap guide 230.

The guide hole 223 may have a width wider than the portion of the strap 210 excluding the stopper 211 and may have a clearance on both sides of the free end portion of the strap 210. Here, the width of the guide hole 223 can be set so as to guide the movement of the free end portion of the strap 210 with a clearance so that the free end portion of the strap 210 can move smoothly without swaying left and right. Meanwhile, the pad 220 may have a protruding area 220*a* extended to the periphery of the guide hole 223 as compared with the pad 120 of the above-described embodiment.

The fitting piece 212 may be fixed to the outer surface of the strap 110. The fitting piece 212 may have a gap with the outer surface of the strap 210 at a portion facing the strap guide 230. The strap guide 230 may be fitted and fixed to a gap formed between the fitting piece 212 and the outer surface of the strap 210. Therefore, the fitting piece 212 can perform the same function as the fitting piece 112 of the above-described embodiment.

The fitting piece 212 has a rectangular cross section and may have a width equal to or narrower than the width of the strap 210. The fitting piece 212 may be attached to the outer surface of the strap 210 with an adhesive or the like. The fitting piece 212 may be made of a plastic material or the like. The fitting piece 212 may be integrally formed with the same material as the strap 210.

The pushing protrusion 213 may be fixed to the inner surface of the strap 210. The pushing protrusion 213 can perform the same function as the pushing protrusion 113 of the above-described embodiment. The pushing protrusion 213 has a rectangular cross section and may have the same width as the width of the strap 210 or a narrower width. The pushing protrusion 213 may be attached to the inner surface of the strap 210 with an adhesive or the like. The pushing protrusion 213 may be made of a plastic material or the like. The pushing protrusion 213 may be integrally formed with the same material as the strap 210.

The protrusion 214 may have a predetermined thickness. In this case, the pad 220 has an extension piece 225 extending from the center of one edge. The extension piece 225 is fixed in a folded state while covering the center of one edge of the pad 220 and can support the protrusion 214. Therefore, by having the protrusion 214 positioned in an inclined state due to the extension piece 225 with respect to the pads 220, the same function as the protrusion 114 of the above-described embodiment can be performed. One edge of the pad 220 may have a convex curved shape at the center.

As such, the multipurpose holder 200 according to another embodiment of the present invention can be used in a state in which the portable terminal 20 is held in a stable state, and the card 30 can be housed. It is possible to use it in various ways and so the usability can be improved.

While the present invention has been particularly shown and described with reference to exemplary embodiments thereof, it will be clearly understood that the same is by way of illustration and example only and is not to be taken by way of limitation and that various modifications and equivalent arrangements may be made therefrom by those skilled in the art. Accordingly, the true scope of protection of the present invention should be determined only by the appended claims.

What is claimed is:

1. A multipurpose holder comprising, a strap which operates such that a central portion is bent or extended as one end portion moves closer to or away from an opposite end portion and is provided with a stopper at the opposite end portion;

a pad formed such that, in a state where the strap is disposed at one face, one end portion of the strap is fixed at one edge thereof, in a state where the strap is spread out, the opposite end portion is supported at an opposite edge thereof, and an area other than where the strap is disposed and operates is formed to be protruded;

a strap guide which has two end portions connected to one face of the pad in a state where the strap guide covers a part of the strap to guide the operation of the strap, and limits the proximity movement of the strap in a bent state by catching against the stopper;

a card pocket formed on an opposite face of the pad so as to house a card through an entrance adjacent to one edge of the pad; and a pushing protrusion formed at the opposite end portion of the strap which catches against an edge of the card within the card pocket in a state of being fitted in the guide hole such that the card is withdrawn from the card pocket when moved to the strap guide.

2. The holder of claim 1, wherein the opposite end portion of the strap comprises a fitting piece which is moved to the strap guide and is fixed with the strap guide at a fitted state.

3. The holder of claim 1, comprising, a guide hole formed to be in communication with the card pocket by being cut into the pad along a trajectory in which the opposite end portion of the strap moves.

4. The holder of claim 3, wherein, the entrance of the card pocket is located more inward than one edge of the pad, and one end portion of the strap is fixed to the pad while being withdrawn around the entrance of the card pocket through one edge of the pad, and a protrusion is formed on a surface of the card pocket facing the periphery of the entrance.

5. The holder of claim 1, wherein a portion excluding the stopper in the strap has a predetermined width, and the holder comprises, a guide hole formed by being cut into the pad from the strap guide to the opposite edge of the pad with a predetermined width so as to be in communication with the card pocket, and formed to fit an opposite end portion of the strap in a state where the stopper is introduced into the card pocket and covered by the pad, to move and guide the strap to the strap guide.

* * * * *